US008583026B2

(12) United States Patent
Nakaishi

(10) Patent No.: US 8,583,026 B2
(45) Date of Patent: Nov. 12, 2013

(54) IMAGE FORMING APPARATUS

(75) Inventor: Yoshiaki Nakaishi, Tokyo (JP)

(73) Assignee: Oki Data Corporation, Tokyo (JP)

( * ) Notice: Subject to any disclaimer, the term of this patent is extended or adjusted under 35 U.S.C. 154(b) by 500 days.

(21) Appl. No.: 12/604,285

(22) Filed: Oct. 22, 2009

(65) Prior Publication Data

US 2010/0104341 A1 Apr. 29, 2010

(30) Foreign Application Priority Data

Oct. 29, 2008 (JP) ..... 2008-278084

(51) Int. Cl.
*G03G 15/00* (2006.01)
*G03G 21/12* (2006.01)

(52) U.S. Cl.
USPC ..... 399/401; 399/35

(58) Field of Classification Search
USPC ..... 399/401, 35
See application file for complete search history.

(56) References Cited

U.S. PATENT DOCUMENTS

| | | | | |
|---|---|---|---|---|
| 6,799,011 | B2 * | 9/2004 | Abe et al. | 399/299 |
| 6,973,283 | B2 * | 12/2005 | Sato et al. | 399/303 |
| 2002/0024579 | A1 * | 2/2002 | Sato et al. | 347/115 |
| 2005/0220515 | A1 * | 10/2005 | Wakana | 399/358 |
| 2006/0045594 | A1 * | 3/2006 | Yamada et al. | 399/358 |
| 2006/0120779 | A1 * | 6/2006 | Uchihashi | 399/358 |
| 2006/0180973 | A1 * | 8/2006 | Igarashi | 271/4.01 |
| 2007/0048038 | A1 * | 3/2007 | Koido | 399/324 |
| 2007/0110458 | A1 * | 5/2007 | Inoue et al. | 399/35 |
| 2008/0131803 | A1 * | 6/2008 | Koido | 430/110.1 |
| 2008/0138133 | A1 * | 6/2008 | Hatayama et al. | 399/360 |

FOREIGN PATENT DOCUMENTS

| | | | | |
|---|---|---|---|---|
| JP | 02251972 | A * | 10/1990 | G03G 15/00 |
| JP | 03069971 | A * | 3/1991 | G03G 15/00 |
| JP | 05257340 | A * | 10/1993 | G03G 21/00 |
| JP | 06130867 | A * | 5/1994 | G03G 15/00 |
| JP | 2002-060091 | A | 2/2002 | |
| JP | 2004061723 | A * | 2/2004 | G03G 15/01 |
| JP | 2010026050 | A * | 2/2010 | G03G 21/10 |
| KR | 2008017645 | A * | 2/2008 | B41J 3/60 |

OTHER PUBLICATIONS

Machine Translation of JP 2004061723 A, JPO, Apr. 16, 2012.*

* cited by examiner

*Primary Examiner* — Ren Yan
*Assistant Examiner* — Nguyen Ha
(74) *Attorney, Agent, or Firm* — Marvin A. Motsenbocker; MOTS Law, PLLC

(57) ABSTRACT

An image forming apparatus includes: a main body of the image forming apparatus; a component of the image forming apparatus attached to the main body of the image forming apparatus; a medium re-feeding path formed in the main body of the image forming apparatus, wherein a medium is turned over while being conveyed through the medium re-feeding path for a double-sided printing; and a guide provided at the component, the guide being adjacent to the medium re-feeding path and configured to guide the medium along the medium re-feeding path.

17 Claims, 11 Drawing Sheets

IMAGE FORMING APPARATUS

CROSS REFERENCE TO RELATED APPLICATIONS

This application claims priority based on 35 USC 119 from prior Japanese Patent Application No. 2008-278089 filed on Oct. 29, 2008, entitled "IMAGE FORMING APPARATUS", the entire contents of which are incorporated herein by reference.

BACKGROUND OF THE INVENTION

1. Field of the Invention

The invention relates to an image forming apparatus that performs printing on a front side and a rear side of a medium.

2. Description of Related Art

In image forming apparatus such as a printer, photocopy machine, facsimile machine, and electrophotographic color recording machine that are capable of printing on both sides of medium, printing is performed on a front side of the medium fed from paper cassette, then the medium is transferred via a medium re-feeding path where the medium is turned over, and thereafter, further printing is performed on a rear side of the medium.

The medium re-feeding path is defined by an upper guide frame and a lower guide frame. The upper guide frame is configured to open or close freely so that medium jams can be prevented. Assuming that a user would handle the upper guide frame in case of a jam, the upper guide frame needs to have enhanced stiffness. Accordingly, the size of the upper guide frame tends to increase. (For example, see Japanese patent publication 2002-60091)

SUMMARY OF THE INVENTION

An aspect of the invention is an image forming apparatus including: a main body of the image forming apparatus; a component of the image forming apparatus attached to the main body of the image forming apparatus; a medium re-feeding path formed in the main body of the image forming apparatus, wherein a medium is turned over while being conveyed through the medium re-feeding path for double-sided printing; and a guide provided at the component, the guide being adjacent to the medium re-feeding path and configured to guide the medium along the medium re-feeding path.

Another aspect of the invention is an image forming apparatus capable of double-side printing including: a development unit disposed in a main body of the image forming apparatus and having a developer image carrier configured to form a developer image thereon; a transfer unit disposed in the main body of the image forming apparatus and configured to transfer the developer image from the development unit to a medium; a cover configured to open and close an opening of the image forming apparatus, wherein one of the development unit and the transfer unit is removable through the opening out of the main body of the image forming apparatus; a medium re-feeding path configured to turn over the medium while conveying the medium; and a pair of guide faces opposite to each other across the medium re-feeding path so as to define the medium re-feeding path and configured to guide of the medium along the medium re-feeding path. One of the development unit and the transfer unit that is removable from the opening is adjacent to the medium re-feeding path, and one of the pair of guide faces is formed at the one of the development unit and the transfer unit that is removable from the opening.

According to the aspects of the invention, the component of the image forming apparatus attached to the main body of the image forming apparatus has the guide or the guide face defining the medium re-feeding path. Therefore, the image forming apparatus no longer needs a cover to open an opening used exclusively for accessing the medium re-feeding path, conveying rollers for the re-feeding path or the like. Thus, the image forming apparatus can be reduced in size.

DETAILED DESCRIPTION OF EMBODIMENTS

Figure 1:
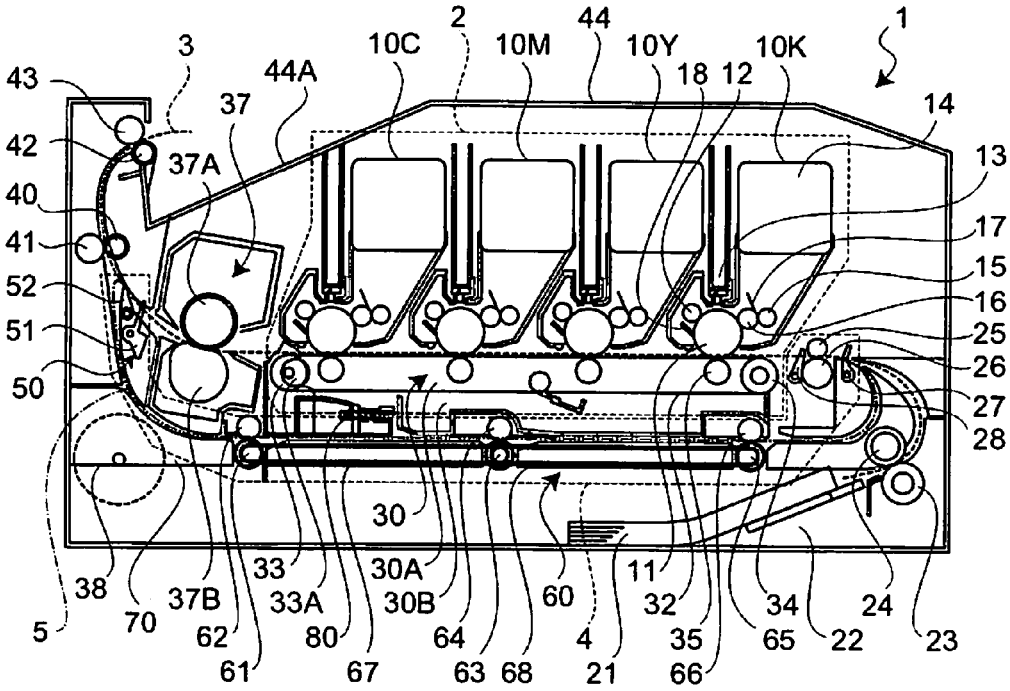
FIG. 1 is a configuration diagram of an image forming apparatus according to the first embodiment.

Descriptions are provided herein below for embodiments based on the drawings. In the respective drawings referenced herein, the same constituents are designated by the same reference numerals and duplicate explanation concerning the same constituents is basically omitted. All of the drawings are provided to illustrate the respective examples only. No dimensional proportions in the drawings shall impose a restriction on the embodiments. For this reason, specific dimensions and the like should be interpreted with the following descriptions taken into consideration. In addition, the drawings include parts whose dimensional relationship and ratios are different from one drawing to another.

Printers of the embodiment are described as an example of an image forming apparatus. The embodiment can be applied not only to printers, but also copiers, facsimile machine or multifunction machines.

First Embodiment

Components of image forming apparatus 1 in the invention are explained as follows. FIG. 1 shows a configuration diagram of an image forming apparatus according to the first embodiment. Image forming apparatus 1 includes image forming unit 2, medium conveying path 3, medium re-feeding unit 4, and medium re-feeding path 5. Image forming unit 2 includes image drum unit 10 that forms a toner image serving as a developer image based on image information, and transfer unit 30 that transfers the toner image to medium 21. Medium conveying path 3 is formed in a S-shape. The S-shaped conveying path starts from media cassette 22 that contains media 21, and ends at discharging tray 44A that receives media 21 on which the image information is printed. While medium 21 is conveyed through medium conveying path 3, the toner images are transferred and fixed on medium 21. Medium re-feeding unit 4 includes components to turn over medium 21 in order to print images on both sides of media 21. Medium re-feeding path 5 is substantially arc-shape. The medium re-feeding path 5 connects a downstream side of fixing unit 37 in medium conveying path 3 to an upstream side of image forming unit 2 in medium conveying path 3. By means of the medium re-feeding path 5, medium 21 that is discharged from fixing unit 37 in medium conveying path 3 is turned over, conveyed to medium re-feeding unit 4, and then discharged to pressure roller 25 and resist roller 26 disposed upstream from image forming unit 2 in medium conveying path 3.

Image forming unit 2 disposed in the main body of image forming apparatus 1 is explained as follows. Image forming unit 2 includes image drum units 10C, 10M, 10Y, and 10K serving as a development unit and transfer unit 30. Image drum units 10C, 10M, 10Y, and 10K form thereon toner images of cyan, magenta, yellow and black respectively based on image information. Transfer unit 30 transfers toner images from image drum units 10C, 10M, 10Y, and 10K onto medium 21. Each of image drum units 10C, 10M, 10Y, and 10K has the substantially same construction except for its developer (i.e. the toner color), so hereinafter these image drum units are thus referred to as image drum unit 10. Components of image drum unit 10 are described in detail as follows, by referring to FIG. 1, and then, components of transferred unit 30 are described in detail by referring to FIGS. 1-6.

Image drum unit 10 serves as a development unit. The image drum unit 10 includes: photosensitive drum 11 which carries electrostatic latent images that are formed based on image information; charging roller 12 which charges the surface of photosensitive drum 11; light source 13 which is disposed in the main body of image forming apparatus 1 and emits lights corresponding to image information onto the surface of photosensitive drum 11; toner cartridge 14 that contains toner as developer; toner supplying roller 15 that supplies toner to developing roller 16; developing roller 16 that supplies toner to the surface of photosensitive drum 11 so as to develop an electrostatic latent image on the surface of photosensitive drum 11; development blade 17 which meters the toner carried on developing roller 16 to a uniform thickness; and cleaning blade 18 which scrapes toner remaining on photosensitive drum 11 after the toner image is transferred to medium 21. Further, image drum unit 10 is easily attached to and detached from the main body of image forming apparatus 1. These components of image drum unit 10 are described in detail as follows by referring to FIG. 1.

Photosensitive drum 11 serves as an image carrier on which toner images serving as developer images can be formed. The surface of photosensitive drum 11 is capable of retaining charge on its surface so that electrostatic latent images can be formed based on image information on the surface. Photosensitive drum 11 is a rotatable cylindrical drum. Such a photosensitive drum 14 has a conductive base layer made of aluminum or the like and a photosensitive layer having a photoconductive layer and a charge transport layer. Charging roller 12 uniformly charges the surface of photosensitive drum 11 by applying predetermined positive or negative charge onto the surface of photosensitive drum 11 using a power source (not shown in figures). Charging roller 12 is rotatable while being in contact with the surface of photosensitive drum 11 with a predetermined pressure. Such a charging roller 12 includes a conductive metal shaft covered by a semi-conductive rubber such as silicon. Light source 13 emits light corresponding to image information onto the surface of photosensitive drum 11 thereby forming electrostatic latent images on the surface of photosensitive drum 11. Light source 13 is disposed in the main body of image forming apparatus 1 such that light source 13 is disposed above photosensitive drum 11. Such a light source 13 includes, for instance, an assembly of a plurality of LED elements, a lens array, and LED drive elements. Toner cartridge 14 is a container for containing toner serving as developer. Toner cartridge 14 is disposed at the upper side from toner supplying roller 15. Toner cartridge 14 is formed, for example, in a rectangular shape as seen from a direction parallel to a conveying direction of medium 21 and a rectangular shape that extends in a direction perpendicular to the conveying direction of medium 21. Toner cartridge 14 is disposed to be freely attached to and detached from the body of the image forming apparatus so that toner cartridge 14 can be exchanged when toner is depleted after the printing operation.

Toner supplying roller 15 is configured to be in contact with developing roller 16 while rotating in order to supply toner to developing roller 16. Such a toner supplying roller 15 is formed of, for example, a conductive metal shaft covered with a rubber in which a foaming agent is added. Developing roller 16 is capable of rotation while being in contact with the surface of photosensitive drum 11 with a predetermined pressure. While rotating, developing roller 16 conveys toner to photosensitive drum 11 thus developing the electrostatic latent image on the surface of photosensitive drum 11 with toner. Such a developing roller 16 is formed in a cylindrical drum shape and made of a conducting metal shaft covered with a semi-conductive urethane rubber or the like. Development blade 17 is disposed such that the tip of development blade 17 slightly touches to the surface of developing roller 16. By scraping excessive toner that was supplied from toner supplying roller 15 over a fixed amount, development blade 17 meters the toner on the surface of developing roller 16 to an uniform thickness. Such a development blade 17 is formed of a plate-shaped resilient member such as stainless steel. Cleaning blade 18 is formed of a plate member made of a rubber material or the like. In order to remove toner remaining on photosensitive drum 11 after the toner image is transferred from photosensitive drum 11 to medium 21, cleaning blade 18 is disposed in a manner that the tip of cleaning blade 18 is in contact with the surface of photosensitive drum 11.

Figure 4:
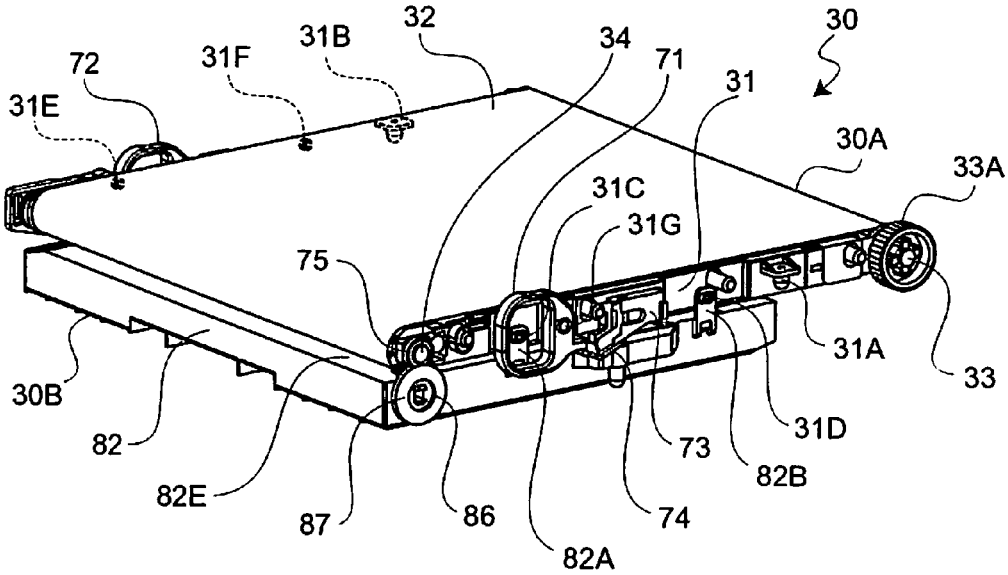
FIG. 4 is a perspective view of the transfer unit according to the first embodiment.

Transfer unit 30 detachably attached to the main body of image forming apparatus 1 is explained as follows. Transfer unit 30 transfers the toner image formed at image drum unit 10 onto medium 21. Transfer unit 30 includes transfer part 30A shown in FIG. 2 and cleaning part 30B shown in FIG. 3. FIG. 4 shows transfer unit 30, with transfer part 30A attached to cleaning part 30B. As is explained later by referring to FIGS. 7 to 9, transfer unit 30 shown in FIG. 4 is attachable to and detachable from image forming apparatus 1. Components in transfer part 30A are described in detail as follows by referring to FIGS. 1 to 4 and 7, and components in cleaning part 30B are described in detail as follows by referring to FIGS. 1, 3 and 7.

Transfer part 30A has transfer frame 31, transfer belt 32, drive roller 33, drive roller driving gear 33A, idle roller 34, transfer roller 35, transfer unit fixing lever 71, transfer unit fixing lever 72, bracket 73, transfer belt cleaning blade 74, and idle roller connecting gear 75. These components of transfer part 30A are described in detail as follows.

Transfer frame 31 is a chassis that rotatably holds drive roller 33 and idle roller 34. Transfer frame 31 is formed in a rectangular shape. Positioning protrusion 31A and positioning protrusion 31B are formed at side faces of transfer frame 31 and are opposite to each other such that positioning protrusion 31A is a mirror image of positioning protrusion 31B. Positioning protrusion 31A and positioning protrusion 31B are engaged respectively with positioning holes 70A and 70B that are formed at base frame 70 of image forming apparatus shown in FIG. 7. Such positioning holes 70A and 70B function as first engagement parts. Protrusions 31C, 31E are projections projecting from side faces of the transfer frame 31 and are opposite to each other such that protrusion 31C is a mirror image of protrusion 31E. Protrusions 31D, 31F are projections projecting from side faces of transfer frame 31 and are opposite to each other such that protrusion 31D is a mirror image of protrusion 31F. Protrusions 31C, 31E and protrusions 31D, 31F are engaged respectively with elongated holes 82A, 82C and 82B, 82D that are formed on waste toner box 82 in cleaning part 30B of transfer unit 30 shown in FIG. 3. Such positioning protrusions serving as second engagement parts are projections. Elongated holes 82A, 82B, 82C, and 82D extend along a direction parallel to the underside face of waste toner box 82. In this embodiment, the underside face of waste toner box 82 is disposed parallel to the conveying direction of medium 21 by transfer belt 32. Therefore, waste toner box 82 is movable in the medium conveying direction, by the length of the elongated holes. Transfer unit fixing lever 71 and transfer unit fixing lever 72 are manual operation levers provided at side faces of transfer frame 31 respectively and are opposite to each other such that one is a mirror image of the other. Transfer unit fixing levers 71 and 72 are rotatable about fixing lever rotation shafts 31G that are formed at side faces of transfer frame 31 respectively and penetrates transfer unit fixing levers 71 and 72. More specifically, when engaging transfer unit fixing levers 71 and 72 with protrusions 70E and 70F of base frame 70 of image forming apparatus shown in FIG. 7, respectively, the image forming apparatus is fixed to transfer unit 30.

Transfer belt 32 serves as a first conveying device. Transfer belt 32 is a conveying belt that conveys medium 21 to image drum unit 10. While medium 21 is conveyed by transfer belt 32, the toner images are transferred onto medium 21. Transfer belt 32 is an endless belt that carries the toner images thereon, and electrostatically attaches medium 21 thereon. Drive roller 33 and idle roller 34 are disposed at both ends and inside of the endless transfer belt 32 and provide a constant tension to transfer belt 32. Drive roller 33 is made of high-friction resistance materials. Drive roller driving gear 33A is connected to one end of drive roller 33. When drive roller driving gear 33A is rotated by a motor (not shown), drive roller 33 rotates. Transfer belt 32 rotates in accordance with the rotation of drive roller 33 to convey medium 21. Note that idle roller 34 is driven by the rotation of transfer belt 32. Transfer roller 35 is disposed in a position facing to photosensitive drum 11 such that transfer roller 35 and photosensitive drum 11 sandwich therebetween medium 21 while both rotate. Bias voltage that is the reverse polarity to the toner charge is supplied to transfer roller 35, thus toner images formed on the surface of photosensitive drum 11 are transferred to medium 21.

Transfer belt cleaning blade 74 functions as a cleaning device. Transfer belt cleaning blade 74 is formed of a plate member made of a rubber material. Transfer belt cleaning blade 74 removes extraneous matter such as toner attached on the surface of transfer belt 32. Removed toner and the like flow into waste toner box 82 in cleaning part 30B of transfer unit 30 shown in FIG. 3. Brackets 73 are joint members to joint transfer belt cleaning blade 74. Brackets 73 are formed at side faces of transfer frame 31, respectively, and are opposite to each other such that one is a mirror image of the other. Idle roller connecting gear 75 is connected to one end of idle roller 34, and drives waste toner stirring/conveying bar 83 as explained later by referring to FIG. 3.

Cleaning part 30B in transfer unit 30 is explained as follows. Cleaning part 30B includes waste toner box 82, waste toner stirring/conveying bar 83, waste toner sealing sponge 84, waste toner sealing sponge 85, shaft connecting gear 86, eccentric shaft 87, film 88 (see FIG. 5) and shaft 89 (see FIG. 5). Components in cleaning part 30B are described in detail as follows by referring to FIGS. 1, 3, 5, 6, and 7.

Figure 7:
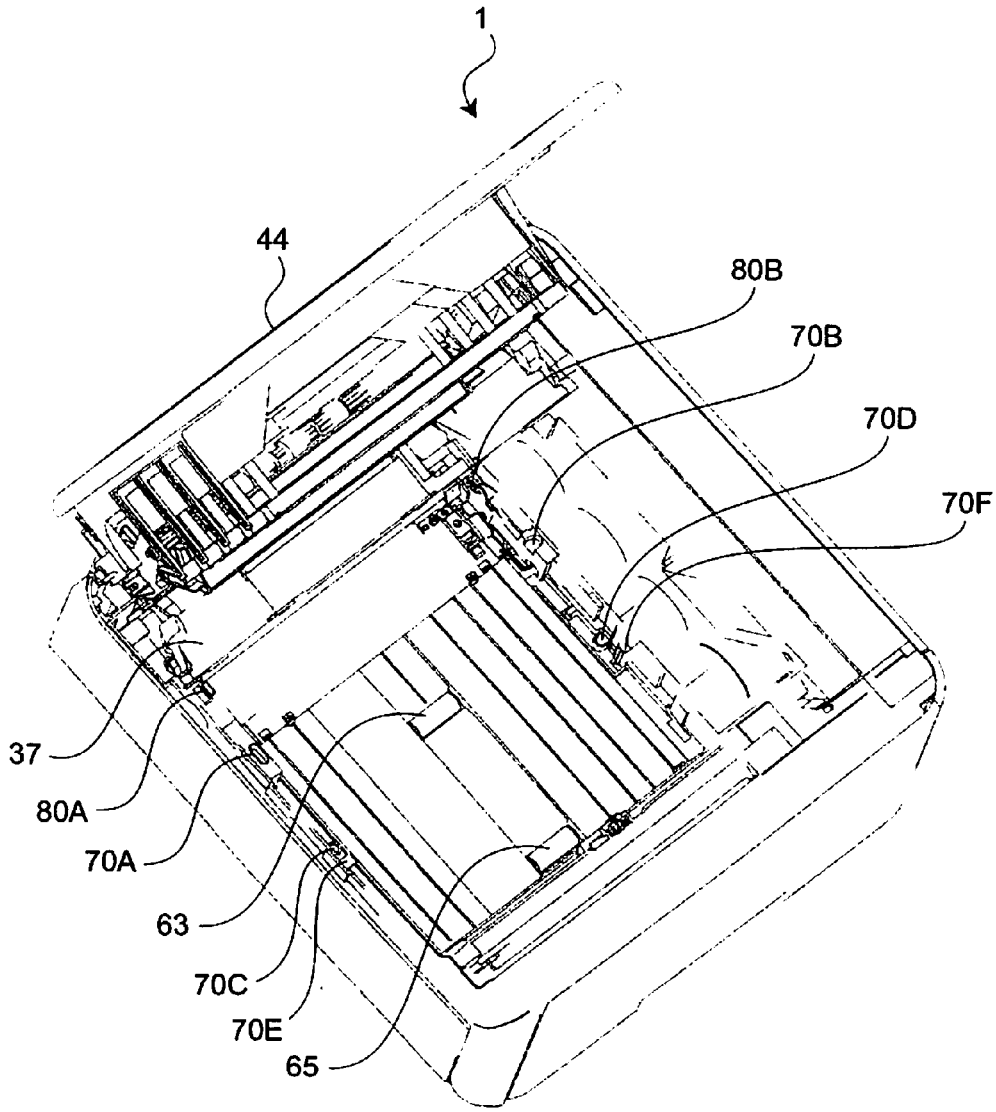
FIG. 7 is a frame format showing a state in which the image drum unit and the transfer unit are removed through an opening opened by an upper cover from the image forming apparatus according to the first embodiment.

Cleaning part 30B is engaged with transfer unit 30A in such a manner that an upper portion of cleaning part 30B is in contact with a lower portion of transfer unit 30A. Waste toner box 82 is a container that contains extraneous matter such as waste toner removed from the surface of transfer belt 32 by transfer belt cleaning blade 74 of transfer part 30A. Waste toner box 82 is formed in a rectangular shape extending along a direction perpendicular to the medium conveying direction as seen from the medium conveying direction, and a rectangular shape extending along the medium conveying direction as seen from the direction perpendicular to the medium conveying direction. Cover 82E is a member that covers waste toner box 82. When transfer unit 30 is attached to the main body of image forming apparatus 1, positioning of waste toner box 82 is completed by inserting positioning protrusions 82I and 82J on side faces of waste toner box into positioning holes 70C and 70D (see FIG. 7) on side faces of base frame 70, respectively. Positioning protrusions 82I and 82J are formed at side faces of waste toner box 82, respectively, and are opposite to each other such that one is a mirror image of the other. Positioning holes 70C and 70D are formed at side faces of base frame 70, respectively, and are opposite to each other such that one is a mirror image of the other as shown in FIG. 7. Guide 82K is formed with a plurality of rib-shaped guiding members formed on the underside face of waste toner box 82, that is, formed on a face adjacent to or facing medium re-feeding path 5. Guide 82K extends along the direction substantially parallel to the medium conveying direction in medium re-feeding path 5. When transfer unit 30 is attached to base frame 70, guide 82K defines medium re-feeding path 5. In other words, medium re-feeding path 5 is defined by an upper side guide and a lower side guide that are opposite to each other across the medium re-feeding path, guide 82K constitutes a part of the upper side guide of medium re-feeding path 5.

Waste toner stirring/conveying bar 83 is formed of a hollow cylindrical member. Waste toner stirring/conveying bar 83 is rotatably disposed in waste toner box 82 in a manner that waste toner stirring/conveying bar 83 is positioned below transfer belt cleaning blade 74 of transfer part 30A, when transfer part 30A and cleaning part 30B are connected. Further, waste toner stirring/conveying bar 83 is driven by the rotation of eccentric shaft 87 that is positioned away from a rotational axis by a certain amount, so that waste toner stirring/conveying bar rotates while moving forwardly, backwardly, upwardly and downwardly. Accordingly, waste toner stirring/conveying bar 83 stirs waste toner in waste toner box 82 that is removed from the surface of transfer belt 32 by transfer belt cleaning blade 74. By the rotation of waste toner stirring/conveying bar 83, retrieved waste toner is conveyed to a rear position of waste toner box 82 while be stirred. This prevents waste toner from sticking and clogging around stirring/conveying bar 83. Shaft connecting gear 86 is provided at one end of eccentric shaft 87. Shaft connecting gear 86 of cleaning part 30B and idle roller connecting gear of transfer part 30A are engaged with each other. Accordingly, waste toner stirring/conveying bar 83 is driven to rotate by the rotation of idle roller 34. Waste toner sealing sponge 84 and waste toner sealing sponge 85 are rectangular shaped gaskets formed at widthwise ends of the upper side of waste toner box 82, respectively, and opposite to each other. Further, waste toner sealing sponge 84 and waste toner sealing sponge 85 project from the upper side of waste toner box 82 at a specific height. When transfer part 30A and cleaning part 30B are connected with each other, waste toner sealing sponge 84 and waste toner sealing sponge 85 are in close contact with on widthwise ends of transfer belt cleaning blade 74 in a predetermined pressure and thereby preventing retrieved toner in waste toner box 82 from leaking from the widthwise ends of transfer belt cleaning blade 74.

Figure 5:
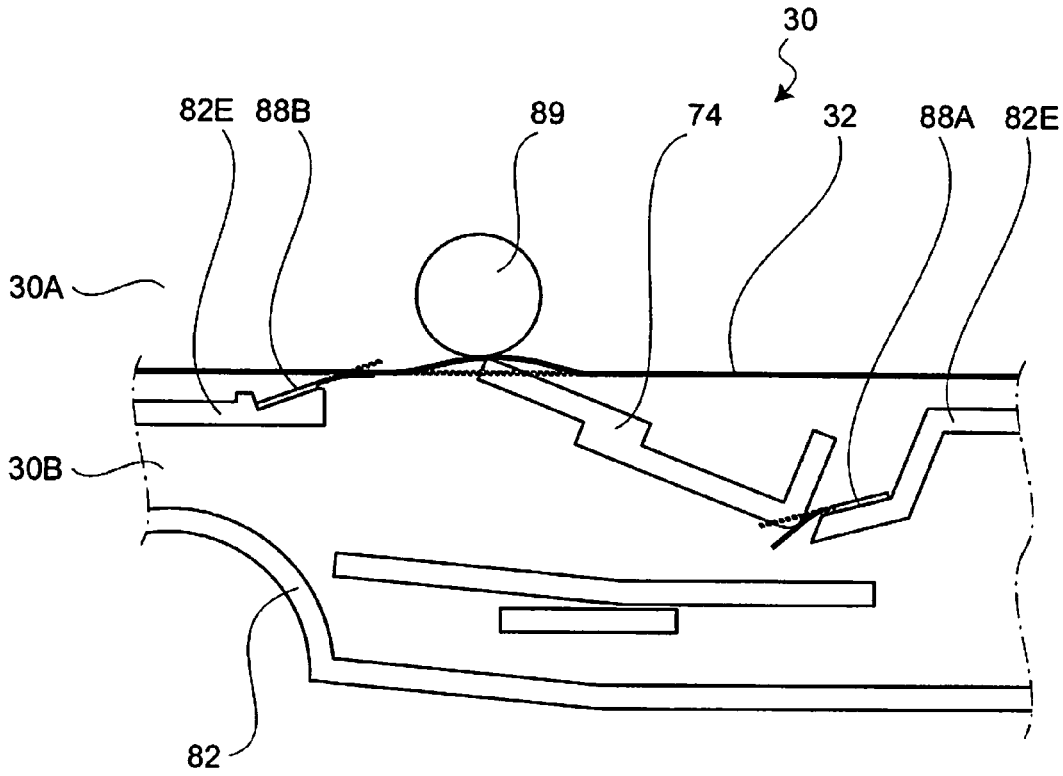
FIG. 5 is a cross-sectional view showing a transfer belt cleaning blade and nearby parts in the transfer unit according to the first embodiment.
Figure 6:
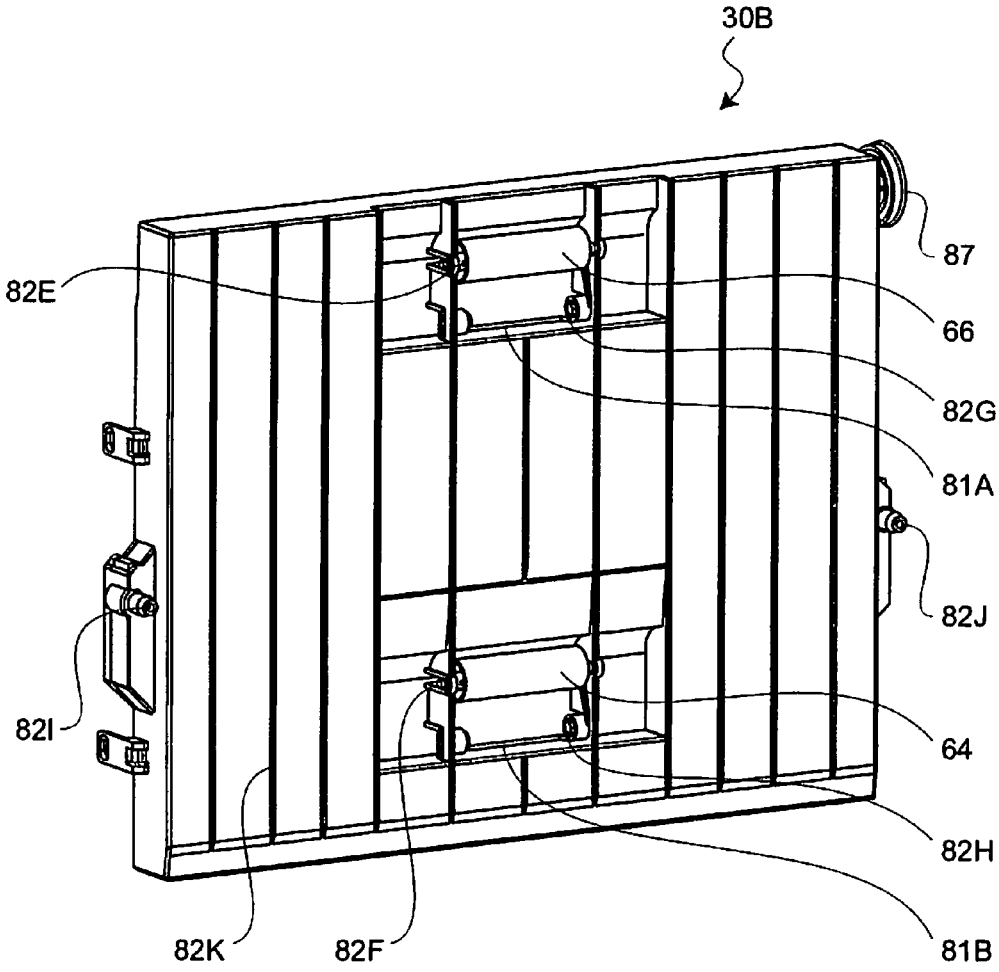
FIG. 6 is a perspective view of a cleaning part in the transfer unit showing a face facing a medium re-feeding path according to the first embodiment.

Film 88 includes film 88A and film 88B that are thin films made of a plastic material that is elastic, flexible, and durable. Films 88A, 88B are adhered and thereby fixed to cover 82E of waste toner box 82, as shown in FIG. 5. Film 88A contacts with one end of transfer belt cleaning blade 74 with a predetermined pressure, and film 88B contacts with the surface of transfer belt 32 with a predetermined pressure, so as to prevent leakage of retrieved toner in waste toner box 82 from the front and back of transfer belt cleaning blade 74 along the medium conveying direction.

Shaft 89 is formed of a cylindrical column member made of metallic material or the like. Shaft 89 is disposed in transfer part 30A and rotatably attached to bracket 73. More specifically, by disposing shaft 89 and one end of transfer belt cleaning blade 74 to face each other in a manner to sandwich transfer belt 32 (see FIG. 5), transfer belt cleaning blade 74 comes into contact with shaft 89 and thereby removes toner attached to transfer belt 32.

Color shift/density shift correction sensor unit 80 is fixed to base frame 70 of the main body of image forming apparatus 1 as shown in FIG. 7. Such color shift/density shift correction sensor unit 80 measures colors and densities of the toner images printed on the surface of transfer belt 32 and sends the measured values to a control unit (not shown), and thereby, based on the measured values, the control unit (not shown) corrects the color misalignments and the densities of the toner images to be formed by image drum unit 10. More specifically, color shift correction/density shift correction sensor unit 80 measures the color misalignments and the densities, by emitting light from a light-emitting part to transfer belt 32, and receiving the reflected light from transfer belt 32 at a light-receiving part. Further, for the light-emitting part of color shift correction/density shift correction sensor unit 80, light emitting diodes, for instance, are used. Similarly, for the light-receiving part, silicon photo diodes, for example, are used.

Medium conveying path 3 defined in image forming apparatus 1 is explained as follows. Medium conveying path 3 starts at medium cassette 22 that contains medium 21, followed by retard roller 23, medium supply roller 24, medium passage detecting sensor 27, pressure roller 25, resist roller 26, medium passage detecting sensor 28, transfer unit 30, fixing unit 37, conveying roller 40, conveying skid 41, discharging roller 42, and discharging skid 43, then, ends at the discharging tray formed on the surface of upper cover 44. Components in medium conveying path 3 are described in detail as follows by referring to FIG. 1.

Medium 21 is a recording medium of predetermined size onto which image information can be formed in black and white or in color. Generally, medium 21 is paper such as recycled paper, gloss paper, high-quality paper, or transparency film used for overhead projection. Medium cassette 22 contains a plurality of media 21. When the printing operation is started, medium 21 in paper cassette 22 is fed into image forming apparatus 1. Further, medium cassette 22 is freely attached to and detached from image forming apparatus 1. Paper supply roller 24 is opposite to retard roller 23 in a manner such that paper supply roller 24 and retard roller 23 sandwich medium 21 and feed media 21 to pressure roller 25 and resist roller 26 that are located downstream of paper supply roller 24 and retard roller 23 in medium conveying path 3. Retard roller 23 applies a friction to media 21 fed from medium cassette 22 so as to prevent double feeding of media 21 to medium conveying path 3. Medium supply roller 24 includes a one-way clutch function that transmits driving force in only one direction, and runs idle when reverse-rotation occurs. Pressure roller 25 and resist roller 26 are disposed to face each other and sandwich conveyed medium 21. By rotating pressure roller 25 pressed by resist roller 26, skewed passage of medium 21 is corrected and medium 21 is conveyed to transfer belt 32 of transfer unit 30 so as to be adhered to transfer belt 32.

Medium passage detecting sensor 27 and medium passage detecting sensor 28 are disposed in front and back of pressure roller 25 and resist roller 26, respectively, and operate based on a fixed control when performing double-sided printing. More specifically, medium passage detecting sensor 27 and medium passage detecting sensor 28 each has a lever with a rotating shaft. By disposing a torsion spring on the rotating shaft, medium passage detecting sensor 27 and medium passage detecting sensor 28 are always biased clockwise as shown in FIG. 1 while being held such that a tip of the lever extends into medium conveying path 3. When medium 21 passes by the lever, medium 21 comes in contact with the tip of the lever to rotate the lever in the counterclockwise direction in FIG. 1. With this operation, medium passage detecting sensors 27 and 28 detect the passage of medium 21. Medium passage detecting sensor 27 and medium passage detecting sensor 28 function as follows. When roller drive motor 38 is driven to rotate in a reverse direction, medium detection by medium passage detecting sensors 27 and 28 starts. When medium 21 passes medium passage detecting sensors 27 and 28, and the trailing edge of medium 21 passes through medium passage detecting sensor 28, the rotation of roller drive motor 38 is stopped.

Medium 21 adhered to transfer belt 32 is conveyed to fixing unit 37, after toner images formed at image drum unit 10 are transferred onto medium 21 by transfer unit 30. Fixing unit 37 includes fixing roller 37A and pressure roller 37B. Fixing roller 37A and pressure roller 37B are disposed to face each other in a manner that they sandwich medium 21 conveyed by transfer belt 32. Fixing unit 37A and pressure roller 37B are configured to fix the toner images on medium 21 to medium 21. More specifically, fixing roller 37A having therein a halogen lamp or a heater heats and melts the toner images on medium 21, while pressure roller 37B applies pressure to the medium, so that the toner images are fixed on medium 21. Pressure roller 37B is biased against fixing roller 37A, and thus rotates with fixing roller 37A accordingly.

Conveying roller 40 and conveying skid 41 are disposed in a matter that they face each other and sandwich medium 21 conveyed from fixing unit 37. Conveying skid 41 is driven to rotate by the rotation of conveying roller 40, thereby conveying medium 21 to discharging roller 42 and discharging skid 43. Conveying roller 40 is connected to roller drive motor 38 disposed beneath conveying roller 40 and conveying skid 41 by a connecting system (not shown). Discharging roller 42 and discharging skid 43 are disposed in a matter that they sandwich medium 21 conveyed from conveying roller 40 and conveying skid 41. Discharging skid 43 is driven to rotate by the rotation of discharging roller 42, thus conveying medium 21 to discharging tray 44A. Being driven by roller drive motor 38, discharging roller 42 and conveying roller 40 rotate in a synchronized manner. Discharging tray 44A is formed on a surface of upper cover 44 of the main body of image forming apparatus 1. Discharging tray 44A is a containing space where media 21, on which image information is printed, is stacked after toner images based on image information are developed, transferred, and fixed on medium 21.

Medium re-feeding unit 4 which forms therein medium re-feeding path 5 in the image forming apparatus according to the embodiment is explained as follows. Medium re-feeding unit 4 functions to turn over medium 21 to print images on both sides of the medium in the image forming apparatus. Medium re-feeding path 5 is formed in medium re-feeding unit 4. Medium re-feeding unit 4 is explained in detail by referring to FIGS. 1, 6, and 7, as follows.

Medium re-feeding unit 4 includes path switching unit 50 and medium conveying unit 60. Path switching unit 50 includes medium passage detecting sensor 51 and path switching separator 52. Medium conveying unit 60 includes drive roller 61, driven roller 62, drive roller 63, driven roller 64, drive roller 65, driven roller 66, transmission belt 67, and transmission belt 68. By controlling medium re-feeding unit 4, medium 21 discharged from fixing unit 37 in medium conveying path 3 is turned over and then, conveyed to pressure roller 25 and resist roller 26 disposed on the upstream side from image forming unit 2 in medium conveying path 3. Path switching unit 50 and medium conveying unit 60 disposed in medium re-feeding unit 4 are described in detail as follows.

Path switching unit 50 is explained as follows. Path switching unit 50 includes medium passage detecting sensor 51 and path switching separator 52. Path switching unit 50 is disposed between fixing unit 37 and conveying roller 40, and operates according to the control for double-sided printing. More specifically, medium passage detecting sensor 51 includes a lever having a rotation shaft. The lever is biased clockwise as shown in FIG. 1 by a torsion spring attached to the rotation shaft so that the lever is held in a manner such that a tip of the lever member extends into medium conveying path 3. When medium 21 passes medium conveying path 3, medium 21 contacts the tip, which rotates the lever counterclockwise as shown in FIG. 1. With this, the medium passage detecting sensor detects the passage of medium 21. Path switching separator 52 includes a lever having a rotation shaft. Path switching separator 52 is biased counterclockwise in FIG. 1 by a torsion spring attached to the rotation shaft while being held in a manner that a tip of the lever extends into medium re-feeding path 5. When double-sided printing is performed, path switching separator 52 is controlled to be rotated to the position where the tip of the lever extending into medium conveying path 3, and thereby medium 21 is conveyed from medium conveying path 3 to medium re-feeding path 5.

Medium passage detecting sensor 52 and path switching separator 52 function as follows. During the double-sided printing operation, when medium passage detecting sensor 52 detect medium 21 discharged from fixing unit 37, roller drive motor 38 is driven to rotate in the positive rotation direction, and thereby conveying roller 40 and discharging roller 42 are driven accordingly to convey medium 21 along medium conveying path 3 up to a position that the rear end of medium 21 passes path switching separator 52. At this point, path switching separator 52 is held in a counterclockwise-rotated manner shown in FIG. 1. Then, upon path switching separator 52 being rotated clockwise and held, the roller drive motor is negatively rotated to drive conveying roller 40 and discharging roller 42. Accordingly, medium 21 is conveyed to drive roller 61 and driven roller 62 in medium conveying unit 60 along medium re-feeding path 5. In other words, medium 21 is conveyed to discharging tray 44A through medium conveying path 3 when roller drive motor 38 is positively rotated, while medium 21 is conveyed to medium re-feeding path 5 when roller drive motor 38 is negatively rotated.

Medium conveying unit 60 is explained as follows. Medium conveying unit 60 includes drive roller 61, driven roller 62, drive roller 63, driven roller 64, drive roller 65, driven roller 66, transmission belt 67, and transmission belt 68. Medium conveying unit 60 is disposed underneath transfer unit 30. Such a medium conveying unit 60 conveys turned-over medium 21 to pressure roller 25 and resist roller 26. Drive rollers 61, 63, and 65 serve as second conveying devices. Drive roller 61 and drive roller 63 are disposed at both sides of transmission belt 67 such as a endless belt in such a manner that drive roller 61 and drive roller 63 stretch transmission belt 67. Similarly, drive roller 63 and drive roller 65 are disposed at both sides of transmission belt 68 such as an endless belt in a manner such that drive roller 63 and drive roller 65 stretch transmission belt 68. When roller drive motor 38 is driven by a transmission system (not shown), drive roller 61, drive roller 63, and drive roller 65 are rotated in a synchronized manner via transmission belt 67 and transmission belt 68.

Driven rollers 62, 64, and 66 serve as third conveying devices. More specifically, driven roller 62, driven roller 64 and driven roller 66 are disposed to face drive roller 61, drive roller 63, and drive roller 65, respectively, in a manner such that each pair of drive roller and driven roller sandwiches medium 21. Mounting hole 82E is a hole to rotatably mount driven roller 66 disposed beneath waste toner box 82. Spring 81A is attached to protrusion 82G formed on one end of mounting hole 83E. By contacting spring 81 A to driven roller 66, drive roller 65 that is disposed in an opposite position to driven roller 66 is biased toward driven roller 66 with a predetermined pressure. In the same manner, mounting hole 82F is a hole to rotatably mount a driven roller 64 disposed beneath waste toner box 82. Spring 81B is attached to protrusion 82H formed on one end of mounting hole 83E. By contacting spring 81B to driven roller 66, drive roller 63 that is disposed in an opposite position to driven roller 64 is biased toward driven roller 64 with a predetermined pressure. Driven roller 62 is rotatably attached to the main body of image forming apparatus 1, and is rotated by the rotations of drive roller 61. As shown in FIG. 7, when opening upper cover 44 provided on an upper side of the main body of image forming apparatus 1, and detaching image drum unit 10 from the main body of image forming apparatus 1, and detaching transfer unit 30 (namely, a part of the upper guide frame that define medium re-feeding path 5), lower guide frame 5 can be exposed.

Next, steps to attach or detach transfer unit 30 to/from the main body of image forming apparatus 1 is explained by referring to FIGS. 2, 3, and 7 to 9.

Figure 8:
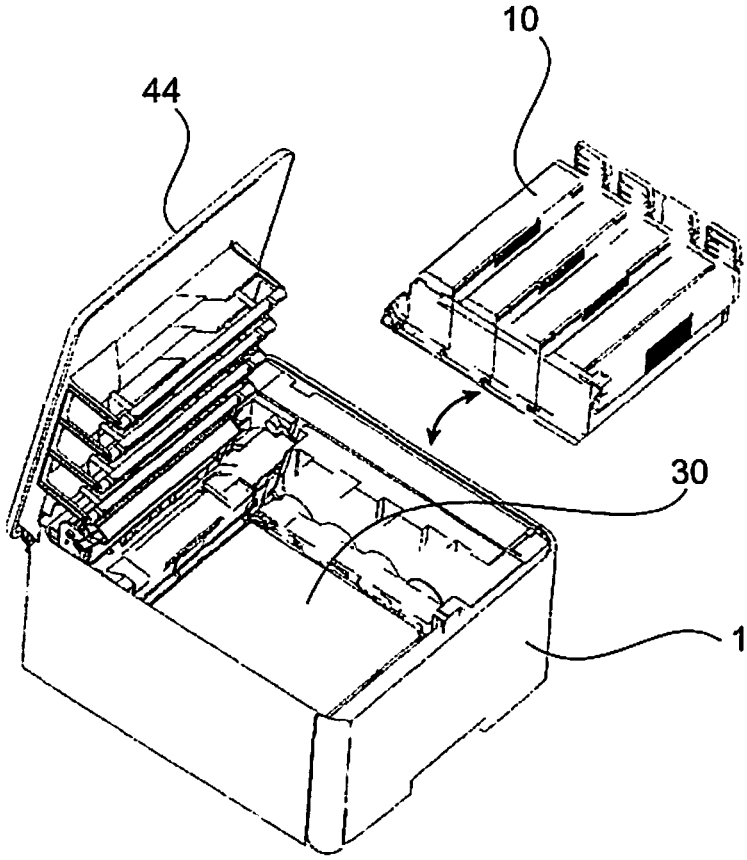
FIG. 8 is a frame format showing a state in which the image drum unit is removed through the opening opened by the upper cover from the image forming apparatus according to the first embodiment.
Figure 9:
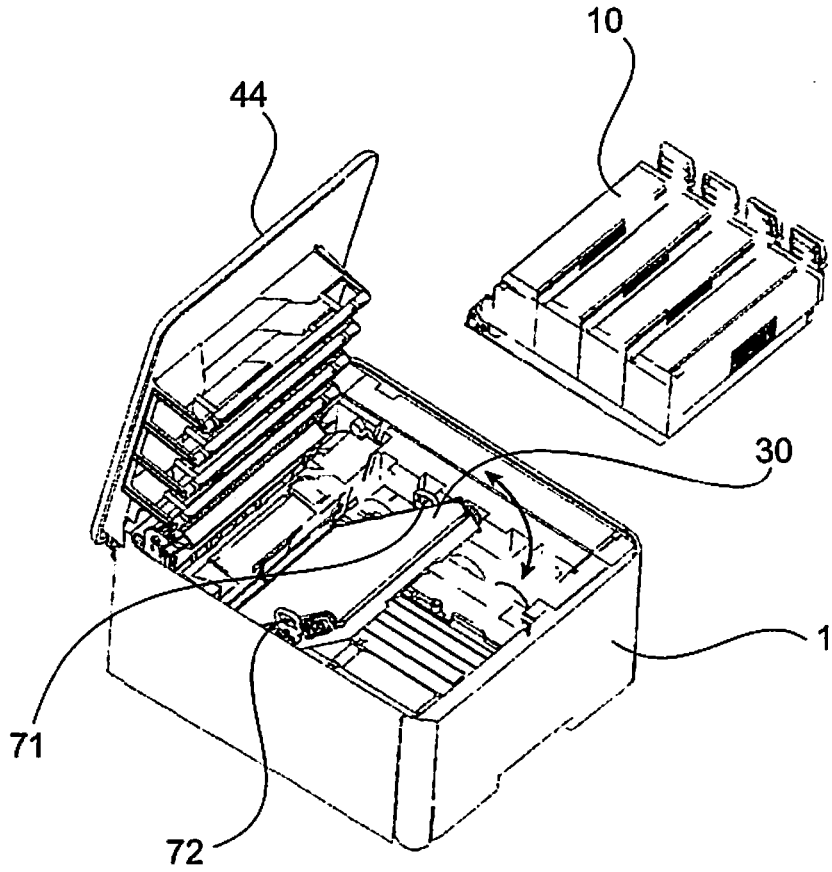
FIG. 9 is a frame format showing a manner of removing the transfer unit in a state where the image drum unit has been removed through the opening opened by the upper cover from the image forming apparatus according to the first embodiment.

Steps to detach transfer unit 30 from the main body of image forming apparatus 1 are explained as follows. As shown in FIG. 8, upper cover 44 provided on the upper side of the main body of image forming apparatus 1 is opened. Next, image drum unit 10 attached in the main body of image forming apparatus 1 is detached. Then, as shown in FIG. 9, by rotating transfer unit fixing lever 71 and transfer unit fixing lever 72 disposed on the side faces of transfer unit 30 in a given direction, transfer unit 30 is detached. That is, the part of the upper guide frame that defines medium re-feeding path 5 is detached. Therefore, medium 21 remaining in medium re-feeding path 5 can be removed where a conveyance of medium 21 failed or so-called jamming or the like occurred in medium re-feeding path 5.

Figure 2:
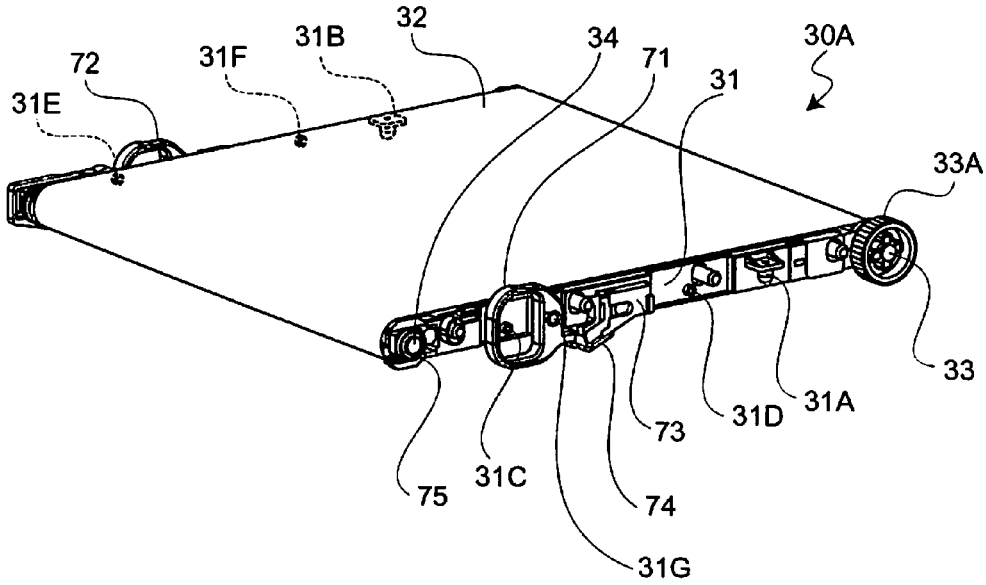
FIG. 2 is a perspective view of a transfer part in a transfer unit according to the first embodiment.
Figure 3:
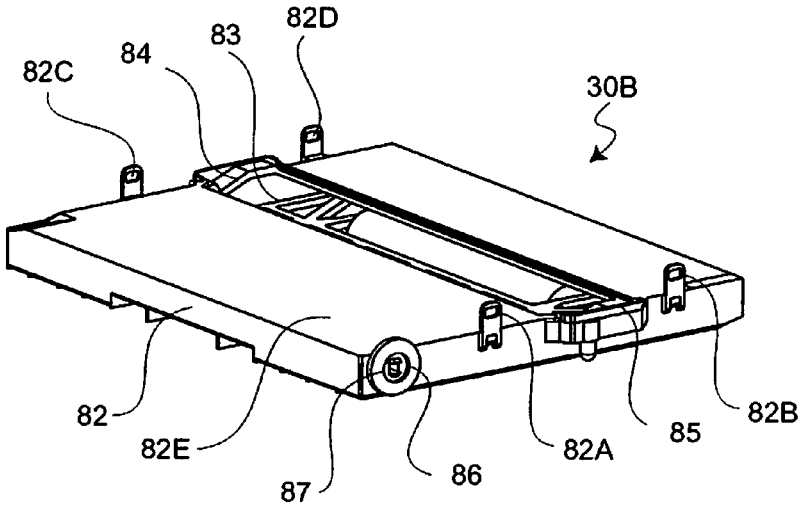
FIG. 3 is a perspective view of a cleaning part in the transfer unit according to the first embodiment.

Steps to attach transfer unit 30 to the main body of image forming apparatus 1 are explained as follows. Attachment of transfer unit 30 is done basically by the reverse order of the detaching steps of transfer unit 30. When attaching transfer unit 30, while each end of the rotation shaft of drive roller 33 shown in FIG. 2 is inserted in shaft receiving part 80A and shaft receiving part 80B respectively, transfer unit 30 is rotated around the rotation shaft of drive roller 33. In this way, positioning protrusions 31A and 31B are inserted into positioning holes 70A and 70B of base frame 70, and positioning protrusions 82I and 82J are inserted into positioning holes 70C and 70D of base frame 70. Shaft receiving part 80A and shaft receiving part 80B are disposed in a manner such that they are opposite each other in an identical position on each side face of shift correction/density shift correction sensor unit 80 fixed in based frame 70 of the main body of image forming apparatus 1 as shown in FIG. 7. In this manner, waste toner box 82 and base frame 70 can be positioned in the medium conveying direction, as waste toner box 82 is movable in the medium conveying direction relative to transfer frame 31. Accordingly, drive roller 63 and driven roller 64, and drive roller 65 and driven roller 66 can be positioned to face each other.

According to the first embodiment explained above, a guide that defines medium re-feeding path 5 is formed on transfer unit 30, so that a cover used exclusively for accessing the re-feeding unit having a medium conveying path and conveying rollers is no longer required. Thus, the image forming apparatus can be reduced in size. Further, the position of waste toner box 82 having the driven rollers can be set along the medium conveying direction relative to base frame 70 of image forming apparatus 1. Therefore, no misalignment occurs between the drive rollers and the driven rollers which are opposite to each other. Further, if the positioning protrusions of waste toner box 82 are broken while attaching or detaching transfer unit 30, transfer unit 30 is easily replaceable as a consumable unit.

In the first embodiment, waste toner box 82 of transfer unit 30 has each driven roller and forms the guide for medium re-feeding path 5. However, when waste toner box 82 is not disposed in transfer unit 30, a guide having driven rollers may be provided at transfer part 30A. In this case, the guide may be movably attached to transfer frame 31 in the medium conveyance direction, so that positions of driven rollers with respect to drive rollers can be set.

In the first embodiment, the guide is formed at waste toner box 82 of transfer unit 30, where transfer unit 30 serves a component of the image forming unit 1 attached to the main body of image forming unit 1. However, the guide may be formed at any component of the image forming unit 1 attached to the main body of image forming unit 1. For example, the guide may be formed either at image drum unit 10 serving as a development unit, or at fixing unit 37. Especially, when a disposition of image drum unit 10 and medium conveying unit 60 becomes opposite in image forming apparatus 1, it is preferable to dispose the guide at image drum unit 10 for ease of attachment consideration.

Second Embodiment

Image forming apparatus 1 according to a second embodiment is explained as follows. In the embodiment, rollers that are disposed in waste toner box are drive rollers. Other constructions regarding image forming apparatus 1 are the same as that in the first embodiment. Thus, in the embodiment, duplicated parts are omitted and the construction that is different from the first embodiment is explained for simplicity.

Figure 10:
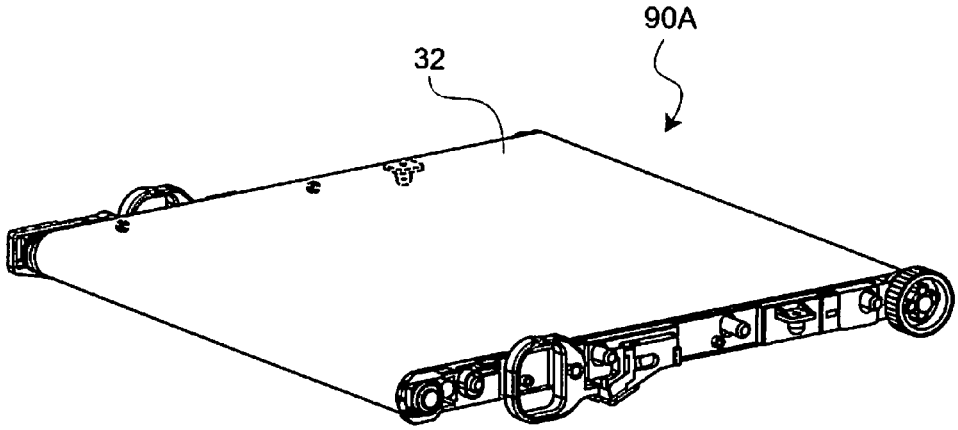
FIG. 10 is a perspective view of a transfer part in a transfer unit according to a second embodiment.
Figure 11:
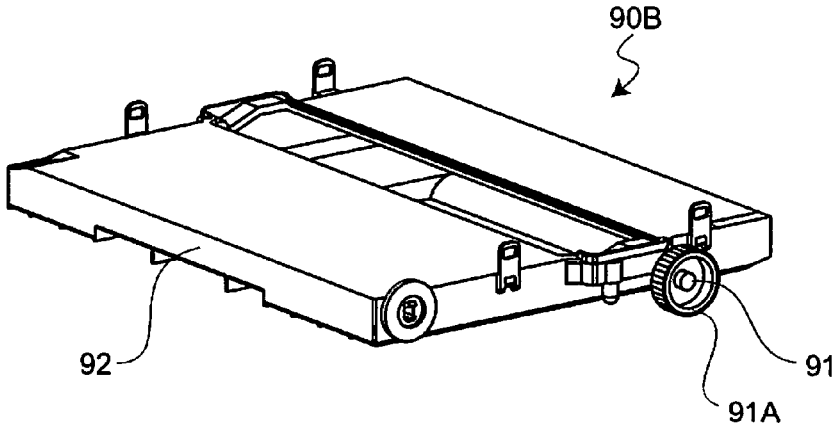
FIG. 11 is a perspective view of a cleaning part of the transfer unit according to the second embodiment.
Figure 12:
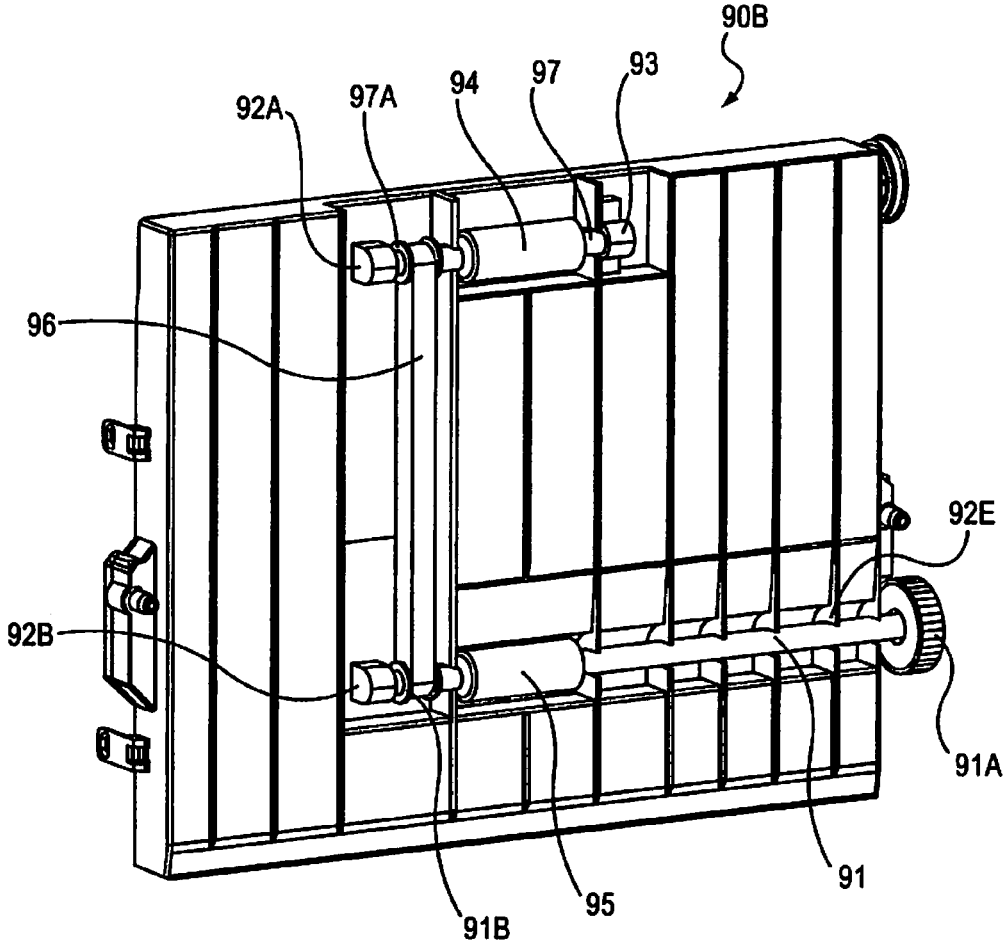
FIG. 12 is a perspective view of the cleaning part of the transfer unit showing a face facing a reverse medium conveying path according to the second embodiment.
Figure 13:
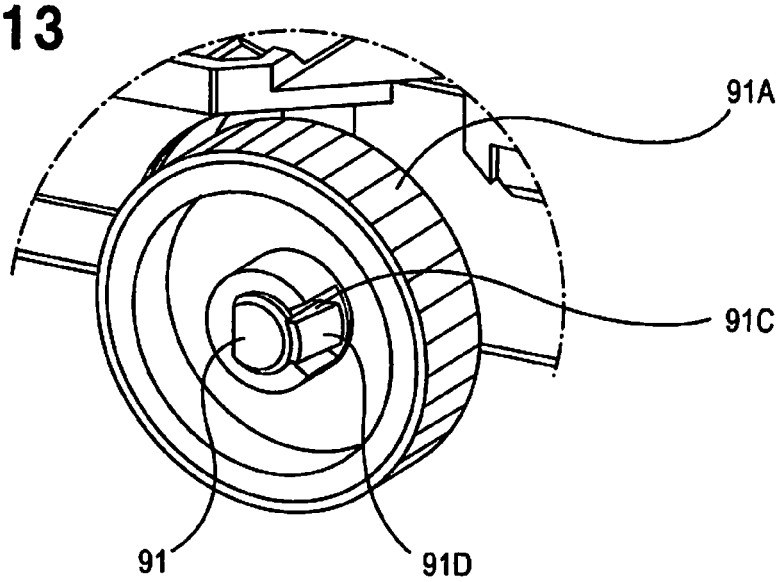
FIG. 13 is a perspective view showing a shaft and a gear of the cleaning part of the transfer unit according to the second embodiment.
Figure 14:
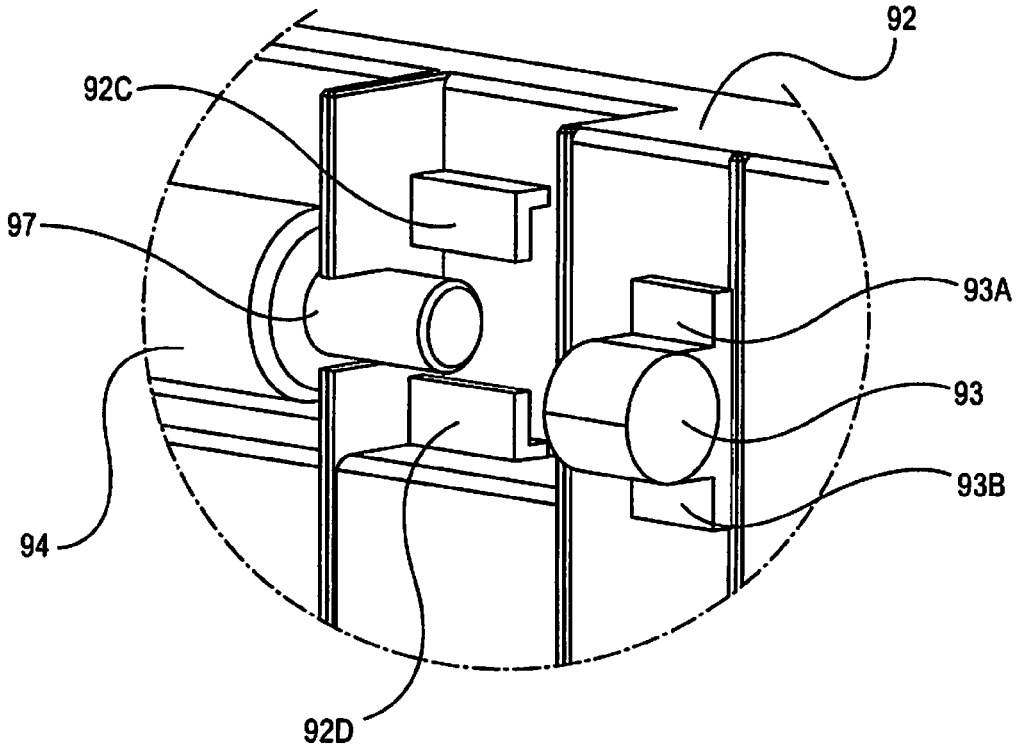
FIG. 14 is a perspective view showing rubber rollers of the cleaning part of the transfer unit according to the second embodiment.

Transfer unit 90 in image forming apparatus 1 includes transfer part 90A and cleaning part 90B. The construction of transfer part 90A is the same as transfer 30A in the first embodiment; however, there is a difference in cleaning part 90B. The following explanation refers to FIGS. 10 to 12. FIG. 10 shows transfer part 90A. FIG. 11 shows cleaning part 90B of transfer unit 90. FIG. 12 shows an underside of cleaning part 90B for transfer unit 90 which defines medium re-feeding path 5. FIG. 13 shows the vicinity of shaft 91 and gear 91A of cleaning part 90B of transfer unit 90. FIG. 14 shows the vicinity of rubber roller 94 of cleaning part 90B of transfer unit 90.

Shaft 91 and shaft 97 penetrate rubber roller 95 and rubber roller 94 respectively, and are attached by bonded anchorage. Shaft 91 is rotatably disposed on shaft receiving part 92B formed on waste toner box 92. Shaft 91 has groove 91C thereon which is engaged with connecting claw 91D formed on gear 91A. Ribs 92E form C-shaped grooves at the position corresponding to shaft 91. Ribs 92E thus function as shaft supporting parts that supports shaft 91. (See FIG. 12) The curve of the C-shaped groove is formed with nearly the same radius as that of shaft 91. The radius of the C-shaped groove is slightly smaller than the radius of shaft 91. Therefore, by press fitting shaft 91 via a cutout into the C-shaped groove, shaft 91 is held rotatably in the C-shaped groove. In a similar manner, shaft 97 is rotatably supported by shaft receiving member 93 having protrusion 93A and protrusion 93B which are fit into and fixed to protrusion 92C and protrusion 92D formed on waste toner box 92. Shaft 91 has pulley 91B at one end thereof, and shaft 97 has pulley 97A at one end thereof. Pulley 91B and pulley 97A are disposed on both sides of endless transmission belt 96 to provide a constant tension to transmission belt 96. By rotating gear 91A using a motor (not shown) provided at the main body of image forming apparatus 1, shaft 91 is rotated, and shaft 97 connected by shaft 91 via transmission belt 96 is rotated accordingly. Thus, rubber roller 95 and rubber roller 94 fixed on shaft 91 and shaft 97 respectively are rotated accordingly.

In the guide frame that is disposed beneath medium re-feeding path 5 in image forming apparatus 1, a driven roller is disposed in a position that faces rubber roller 94 and rubber roller 95 provided at transfer unit 90, when transfer unit 90 is attached to image forming apparatus 1. As described above, in the first embodiment, the driven roller is provided at waste toner box 82 whereas in the second embodiment, the drive roller is provided at waste toner box 82. When double-sided printing is performed, medium 21 that is introduced to medium re-feeding path 5 via path switching unit 50, is refed to image drum unit 10 via medium conveying unit 60 by rotating rubber roller 94 and rubber roller 95 driven by a motor (not shown). As the same as described in the first embodiment, waste toner box 92 is disposed movably relative to transfer part 90A. Therefore, waste toner box 92 is able to align against the main body of image forming apparatus 1. Therefore, gear 91A and the motor that is provided at the main body of image forming apparatus 1 are reliably engaged with each other.

As described above, the second embodiment where the drive roller is disposed in waste toner box 92 can obtain the same effect, in terms of size reduction of the image forming apparatus 1, as the first embodiment where driven roller is disposed in waste toner box 82. Further, each of the worn rubber rollers is replaceable at the same time by making transfer unit 30 as a consumable unit.

In the above-mentioned first embodiment and second embodiment, image forming apparatus is explained as a printer; however, image forming apparatus 1 in these embodiments can be formed in a copier, facsimile machine, MFP machine, and so on. Further, image drum unit 10 in the embodiments include four image drum units 10C, 10M, 10Y, and 10K that develop image information corresponding to cyan, magenta, yellow, and black respectively; however, image unit 10 may includes image unit 10C, 10M, and 10Y that correspond to three colors other than black. Further, image drum unit 10 may be formed of two image drum units 10K that develop image information each corresponding to black. As such, color combination of image drum unit 10, and quantity of image drum unit 10, and so on are not limited to the above-mentioned descriptions but they can be changed accordingly within the concept of the invention.

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

What is claimed is:

1. An image forming apparatus comprising:

a main body of the image forming apparatus;

a component which is detachable from the main body of the image forming apparatus;

a medium re-feeding path formed in the main body of the image forming apparatus, wherein a medium is turned over while being conveyed through the medium re-feeding path for a double-sided printing; and a guide provided at the component, the guide including a flat face facing the medium re-feeding path and extending in a medium conveying direction in the medium re-feeding path and configured to guide the medium along the medium re-feeding path; and a development unit configured to form a developer image;

wherein the component is a container provided between the medium re-feeding path and a transfer unit configured to transfer the developer image formed by the development unit to the medium, wherein the main body of the image forming apparatus is formed with a first conveying device, and wherein the guide is formed with a second conveying device opposite to the first conveying device across the medium re-feeding path.

2. The image forming apparatus according to claim 1, wherein the medium re-feeding path passes around at least a transfer belt of the transfer unit.

3. The image forming apparatus according to claim 1 wherein the guide is movably supported by the component.

4. The image forming apparatus according to claim 1 wherein the guide is supported by the transfer unit in a movable manner.

5. The image forming apparatus according to claim 1 wherein the main body of the image forming apparatus is formed with a first engagement part, and the component is formed with a second engagement part configured to engage with the first engagement part.

6. The image forming apparatus according to claim 5 wherein the first engagement part is a positioning hole, and the second engagement part is a projection corresponding to the positioning hole.

7. The image forming apparatus according to claim 1 wherein the transfer unit is detachably attached to the main body of the image forming apparatus.

8. The image forming apparatus according to claim 1 wherein the development unit is detachably attached to the main body of the image forming apparatus.

9. The image forming apparatus according to claim 1 wherein the transfer unit includes third conveying device configured to convey the medium; and a cleaning device configured to remove extraneous matter from the third conveying device.

10. The image forming apparatus according to claim 9 wherein the container contains the extraneous matter removed by the cleaning device.

11. The image forming apparatus according to claim 10 wherein the container is supported by the transfer unit in a movable manner.

12. The image forming apparatus according to claim 10 wherein the second conveying device is a drive roller configured to be rotated by a drive source, and the first conveying device is a driven roller configured to be rotated by the rotation of the drive roller.

13. The image forming apparatus according to claim 12 wherein the container of the transfer unit includes the second conveying device opposite to the first conveying device in a state where the transfer unit is attached to the main body of the image forming apparatus.

14. The image forming apparatus according to claim 12 wherein the first conveying device is a drive roller configured to be rotated by a drive source, and the second conveying device is a driven roller configured to be rotated by the rotation of the drive roller.

15. An image forming apparatus capable of double-side printing comprising:

a development unit disposed in a main body of the image forming apparatus, the development unit configured to form a developer image on a developer image carrier;

a transfer unit disposed in the main body of the image forming apparatus and configured to transfer the developer image formed by the development unit to a medium;

a cover configured to open and close an opening of the image forming apparatus, wherein one of the development unit and the transfer unit is removable through the opening out of the main body of the image forming apparatus;

a medium re-feeding path configured to turn over the medium while conveying the medium;

a container detachable from the main body of the image forming apparatus and provided between the medium re-feeding path and the transfer unit; and a pair of flat guide faces opposite to each other across the medium re-feeding path so as to define the medium re-feeding path, and configured to guide the medium along the medium re-feeding path, the guide faces extending in a medium conveying direction in the medium re-feeding path;

wherein one of the pair of guide faces is formed at the container that is removable through the opening, the other of the pair of the guide faces is formed with a first conveying device, and the one of the pair of the guide faces is formed with a second conveying device opposite to the first conveying device across the medium re-feeding path.

16. The image forming apparatus according to claim 15, wherein the medium re-feeding path passes around at least a transfer belt of the transfer unit.

17. The image forming apparatus according to claim 15, further comprising:

a cleaning device configured to remove extraneous matter from a conveying device of the transfer unit, wherein the container contains the extraneous matter removed by the cleaning device.

* * * * *